United States Patent [19]

Lee

[11] 3,996,533

[45] Dec. 7, 1976

[54] HIGH FREQUENCY, MULTI-THROW SWITCH EMPLOYING HYBRID COUPLERS AND REFLECTION-TYPE PHASE SHIFTERS

[76] Inventor: Chong W. Lee, 22 Heritage Drive, Lexington, Mass. 02173

[22] Filed: July 7, 1975

[21] Appl. No.: 593,904

[52] U.S. Cl. ..... 333/7 R; 333/10; 333/31 R; 333/7 D

[51] Int. Cl.[2] ..... H01P 1/10

[58] Field of Search ..... 333/10, 11, 7 R, 7 D

[56] References Cited

UNITED STATES PATENTS

| | | | |
|---|---|---|---|
| 3,032,723 | 5/1962 | Ring | 333/7 D X |
| 3,559,108 | 1/1971 | Seidel | 333/7 D |
| 3,571,765 | 3/1971 | Friedman | 333/7 R X |
| 3,769,610 | 10/1973 | Savarin et al. | 333/10 |

*Primary Examiner*—Paul L. Gensler
*Attorney, Agent, or Firm*—Robert T. Dunn

[57] ABSTRACT

A basic electrical switch for switching alternating (frequency) electrical signals between four symmetrical switching terminals generates, in response to command signals, any of a plurality of switch patterns which provide simultaneous transmission paths between terminals of different pairs and isolation between terminals of different pairs. The switch consists of four hybrid couplers and four reflection-type phase shifters, which are arranged so that the input signal to a coupler is divided equally into two parts, each of which undergoes proper phase shifts by the command signals to emerge from the desired output terminal, either in phase for transmission or out of phase for isolation of the signal. Within each switching state, the signal can also be controlled in biphase by the command signals. The terminals are matched to the characteristic impedance of the switch under any switching state and so, a plurality of such basic electrical switches can be connected at their terminals to provide an "M × N" matrix switch pattern subject to command signals, without intricate connections of external wires or cables, by simply arranging the basic switches in a proper matrix format on a single plane.

11 Claims, 5 Drawing Figures

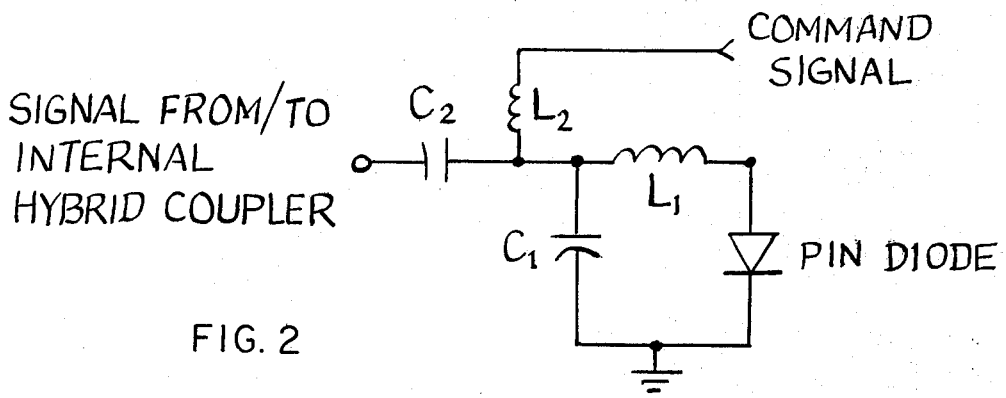
FIG. 2
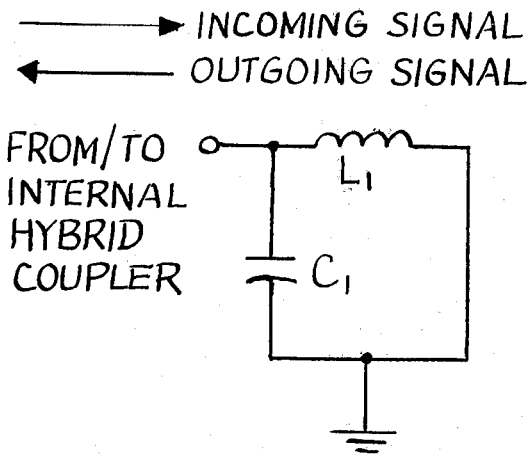
$$\frac{\text{OUTGOING SIGNAL}}{\text{INCOMING SIGNAL}} = |1| \angle \phi_{REF.}$$
FIG. 3(a) FORWARD BIAS
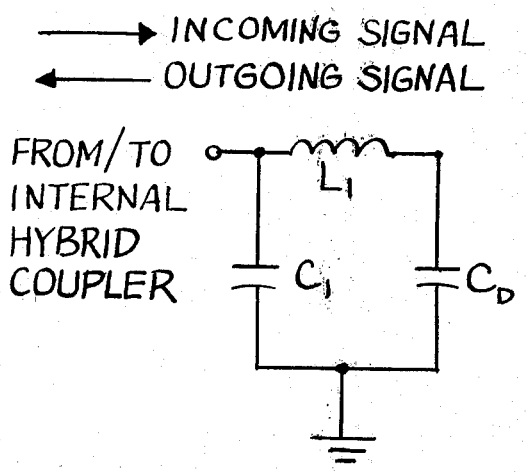
$$\frac{\text{OUTGOING SIGNAL}}{\text{INCOMING SIGNAL}} = |1| \angle \phi_{REF.} - 180^\circ$$
FIG. 3(b) REVERSE BIAS

HIGH FREQUENCY, MULTI-THROW SWITCH EMPLOYING HYBRID COUPLERS AND REFLECTION-TYPE PHASE SHIFTERS

BACKGROUND OF THE INVENTION

This invention relates to electrical switches and more particularly to solid state high speed, high frequency, wide bandwidth switches for switching signals between several switch terminals in a matrix pattern, wherein there is a basic switching mechanism that relies on controllable phase shifters.

Heretofore, the basic mechanism employed in electrical switches has been a mechanism which conducts or blocks signals either mechanically or electrically. In semi-conductor switching devices such as switching diodes, the low impedance and high impedance characteristics of the diode provided by the forward bias and reverse bias conditions, respectively, are used as the switching mechanism. These conducting and/or blocking devices are inserted in the signal paths in series, shunt or combinations of both to form, in general, a single Pole N Throw (SPNT) (most commonly, a Single Pole 3 Throw — SP3T), Double Pole Double Throw (DPDT) or Transfer Switches. The function of each of these switches is limited to the switch action (pattern) as its name implies. Therefore in order to realize more intricate switch patterns such as a matrix switch pattern, two or more of these switches are interconnected often by external cables crossing each other.

SUMMARY OF THE INVENTION

The present invention relates more particularly to matrix switches in which the basic switch is capable of generating any of the switch patterns of the SPNT, the DPDT and the Transfer Switch, or a matrix pattern of one row by one column. Furthermore, within each switching state, a 180 degree phase shift can be introduced to the switched signal by a control or command signal. The basic switch has four symmetrical switching terminals which are, under any switching state, matched to the characteristic impedance of the switch so that each terminal can be directly connected to any other terminal of similar basic switches. This interconnecting capability with its intrinsic novel switching pattern makes it possible to generate an "M × N" matrix switch pattern by simply arranging the basic switches in a proper matrix format on a single plane without the complicated interconnection of external wires or cables.

Particular embodiments of the present invention incorporate a circuit arrangement of hybrid couplers and reflection-type phase shifters. In all embodiments described herein, there are four switch terminals, four hybrid couplers and four reflection-type phase shifters in the basic switch circuit. Two couplers are referred to as switch terminal couplers and the other two are referred to as switch internal couplers and each coupler has four terminals. Two of the terminals are connected directly (or through transformers) to input terminals of one terminal coupler and the other two switch terminals are connected to terminals of the other terminal coupler also directly or through transformers. The outputs of the two terminal couplers are fed to the inputs of the internal couplers, and reflection-type phase shifter circuits are provided at the outputs of the internal couplers for reflecting signals issuing therefrom back into the internal couplers in controlled phase depending upon control or command signals applied to the phase shifter circuits. These command signals determine the switching state of the switch and the phase of the switched signal. In all embodiments of the present invention, the basic switch is capable of four different switching states including a state in which all switch terminals are isolated from each other, and two phase states for each switching state.

In preferred embodiments of the basic switch, the reflection-type phase shifters terminating the outputs of the switch internal couplers operate in a binary fashion and return signals back to the associated internal coupler in one relative phase or another. Furthermore, phase reflection-type phase shifters are controlled by binary command signals, and a set of such command signals simultaneously applied to the phase shifters define a binary command word. Each binary command word represents a different state of the switch.

In preferred embodiments of the present invention, the hybrid couplers are all four terminal hybrid coupler devices such as 3db 90° couplers, 3db 180° couplers, Magic-Ts or other types of hybrid couplers having four terminals and capable of dividing power of a signal fed to any one of the terminals between two other terminals while isolating the one terminal from the remaining terminal thereof. Futhermore, all the hybrid couplers of the switch operate in a reciprocal manner in that a signal applied to one of two input terminals appears divided at the two output terminals and a signal applied to one output terminal appears divided at the two input terminals.

Specific embodiments of the present invention, described herein, include an embodiment incorporating four 3db 90° hybrid couplers, an embodiment incorporating four 3db 180° hybrid couplers and embodiments incorporating a combination of 3db 90° couplers and 3db 180° couplers. These specific embodiments are examples of particular constructions of the basic switch using two very well-known types of hybrid couplers. Many other types of signal and/or power dividers and combinations of the same will occur to those skilled in the art without departing from the spirit and scope of the present invention.

The controllable phase shifter circuits coupled to the output of the two internal hybrid couplers of the switch can be constructed in many different ways. The function of each such phase shifter is to intercept the electrical signal issuing from the associated output terminal of the internal hybrid coupler and to return that signal to the same said terminal in one relative phase or another, depending upon a command signal applied to the phase shifter circuit. In the specific embodiments of the present invention described herein, the intercepted signal is returned either in the reference phase, called zero degree phase, or 180° from the reference phase. Furthermore, the states of the two phase shifters associated with the two terminals of a given internal hybrid coupler are phase related, because the returned signals for each operated on by the internal hybrid coupler must either reinforce or cancel the signals at the input of the same hybrid coupler. A typical construction of the controllable reflection-type phase shifter circuit is described herein.

It is an object of the present invention to provide a four-terminal switch in which some of the limitations of prior electrical switches are avoided.

It is another object to provide an electrically controlled switch capable of a plurality of different switching states in which different combinations of terminals are isolated from each other.

It is another object to provide an electrically controlled switch capable of delivering biphase signal states at each switching state.

It is a further object to provide such an electrically controlled switch in which all combinations of pairs of terminals can be electrically coupled with relatively low insertion loss between terminals of a pair and all combinations of pairs of terminals can be electrically isolated from each other.

It is another object to provide a basic four-terminal electrically controlled switch for use in a matrix of such switches wherein each switch is capable of a multitude of different switching states and so, a great variety of switching patterns of the matrix are possible through electrical control of the individual switches in the matrix.

It is another object to provide an improved high frequency Single Pole Three Throw (SP3T), Double Pole Double Throw (DPDT), and Transfer Switch.

These and other objects and features of the present invention will be apparent in view of the specific descriptions of embodiments of the invention taken in conjunction with the drawings.

DESCRIPTION OF THE DRAWINGS

FIG. 2 is an electrical diagram of a suitable circuit for use as controlled phase shifter circuit in the switch shown in FIG. 1;

FIGS. 3*a* and 3*b* are the equivalent circuits of phase shifter in FIG. 2 under two different bias conditions.

DESCRIPTION OF EMBODIMENTS OF THE INVENTION

Figure 1:
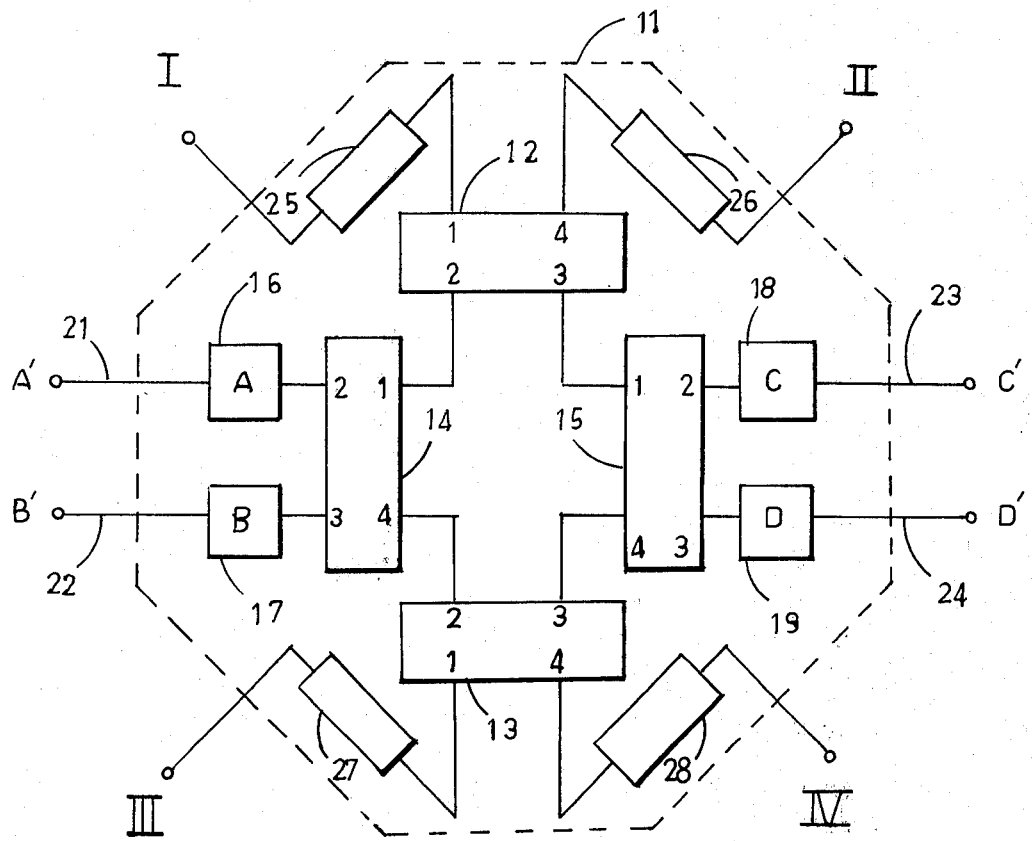
FIG. 1 is an electrical block diagram showing the basic structure of the four-terminal switch incorporating features of the present invention.

The block diagram of FIG. 1 illustrates the basic construction of the switch in accordance with the present invention. This diagram illustrates the parts of the switch and the functions of the parts. The parts include the four terminals, denoted I, II, III and IV which may extend beyond the body 11 of the switch. Within the body 11 of the switch, all parts may be contained on a single circuit board or circuit chip, or all may be encapsulated as a single unitary package. That package includes the two terminal hybrid couplers 12 and 13, the two internal hybrid couplers 14 and 15 and four controlled phase shifter circuits 16, 17, 18 and 19. These phase shifter circuits, denoted A, B, C and D are controlled by the command signals A′, B′, C′ and D′, respectively. Electrical leads 21 to 24 carry the signals A′, B′, C′ and D′ to their respective phase shifter circuits and these leads may extend from the package 11 for connection to the sources of the command signals, (not shown).

The four hybrid couplers 12, 13, 14 and 15 each has four terminals and in each case the terminals are numbered 1 to 4. Furthermore, in each of these hybrid couplers, the terminals 1 and 4, which are isolated from each other, are referred to as the input terminals and the terminals 2 and 3, which are isolated from each other, are referred to as the output terminals. The four hybrid couplers 12 to 15 each divide power fed to either of the inputs thereof equally to the two outputs thereof. Hence, a signal fed to terminal 1 of a hybrid coupler is divided equally at the two output terminals 2 and 3 and a signal fed to terminal 4 is also divided equally at the two output terminals. Furthermore, all the hybrid couplers 12 to 15 operate reciprocally and so, in any of these, a signal fed to terminal 3 is divided equally at terminals 1 and 4 and a signal fed to terminal 2 is also divided equally at terminals 1 and 4.

The switch terminals, I, II, III and IV are connected, through transformers 25, 26, 27 and 28, respectively, in case the characteristic impedance of the coupler differs from that of the switch terminal. Otherwise, the switch terminals connect directly to the associated input terminals of the terminal couplers.

FIG. 2 illustrates one construction and the function of each of the controlled reflection-type phase shifter circuits A, B, C and D, denoted 16 to 19, respectively. The function of each of these circuits is to intercept the signal issuing from the terminal of the hybrid coupler to which it is coupled and to return the intercepted signal to the same terminal of the hybrid coupler, either in the reference phase or 180° from the reference phase, depending upon the command signal applied to the phase shifter circuit. This operation is shown in FIG. 3 employing an electrically controlled 180° reflection-type phase shifter. For example, where the phase shifter circuit shown in FIG. 2 is circuit A, denoted 16, the input of the circuit is connected to terminal 2 of hybrid coupler 14 and the command signal A′ is applied to the switch through line 21. If the command signal is a binary signal designated a one or zero, (denoted herein also as a 1 or 0), then a zero command signal may cause the signal issuing from terminal 2 to be directed back to that same terminal in a reflective phase denoted $\phi$-180° and a binary one command signal causes the phase shifter to direct the signal back to the same terminal in the reflective phase $\phi$.

The four phase shifter circuits A, B, C and D may be identical and each responds to the associated command signal A′, B′, C′ and D′, respectively, and the command signal may be binary. In preferred embodiments of the invention, the command signals are applied simultaneously to their associated phase shifter circuits and all electrical delays in these circuits are the same. Furthermore, the command signals A′ to D′ define a binary command word and each binary command word results in a different switching state of the basic switch shown in FIG. 1.

In operation of the basic switch shown in FIG. 1, an alternating (frequency) signal at terminal I will be coupled with very low insertion loss to one of the other terminals of the basic switch depending upon the binary command word defined by the command signals A′ to D′ and also depending upon the nature of the four hybrid couplers 12, 13, 14 and 15. For example, where all four of these hybrid couplers are 3db 90° couplers, then the binary command word will result in certain switching states. These switching states and the binary command words are listed in Table I below.

TABLE I

| ALL HYBRID COUPLERS ARE 3DB 90°-COUPLERS | | | | | | | |
|---|---|---|---|---|---|---|---|
| Command Signals | | | | Terminals Electrically Coupled (minimum insertion loss) | | | |
| A' | B' | C' | D' | | | | |
| 1 | 1 | 1 | 1 | or | I-IV and II-III | at | 0° or |
| 0 | 0 | 0 | 0 | | | | 180° |
| 0 | 0 | 1 | 1 | or | I-III and II-IV | at | 0° or |
| 1 | 1 | 0 | 0 | | | | 180° |
| 1 | 0 | 0 | 1 | or | All terminals isolated: | at | 0° or |
| 0 | 1 | 1 | 0 | | I-I, II-II, III-III, and IV-IV | | 180° |
| 0 | 1 | 0 | 1 | or | I-II and III-IV | at | 0° or |
| 1 | 0 | 1 | 0 | | | | 180° |

Where the command word defined by the command signals A', B', C' and D' is 1 1 1 1 or 0 0 0 0, it can be shown that the alternating (frequency) signal at terminal I will appear at terminal IV, but will be isolated from terminals II and III. Similarly, a frequency signal appearing at terminal IV will be coupled to terminal I, but will be isolated from terminals II and III. Also, frequency signals will be coupled between terminals II and III and they will be isolated from terminals I and IV. For example, if the frequency signal at switch terminal I appears at terminal 1 of coupler 12, through lossless transformer 25, as 100/0°, which signifies a voltage magnitude of 100 at phase 0°, that signal will be divided by 3db 90°-coupler 12 and appear at terminals 2 and 3 of the coupler in quadrature. More particularly, the signal at terminal 2 will be designated $$\frac{100}{\sqrt{2}} \angle 0°$$

and the signal at terminal 3 will be designated $$\frac{100}{\sqrt{2}} \angle -90° .$$

From terminal 2 of coupler 12, the signal will be process through 3db 90°-coupler 14 and the A and B phase shifters 16 and 17.

The signal $$\frac{100}{\sqrt{2}} \angle 0°$$

at terminal 1 of coupler 14 appears at terminal 2 of the coupler at $$\frac{100}{2} \angle 0°$$

and at terminal 3 of the coupler as $$\frac{100}{2} \angle -90° .$$

If the A phase shifter 16 is under the control of a binary one command signal (A') through lead 21, the signal at terminal 2 of coupler 14 designated as $$\frac{100}{2} \angle 0°$$

will appear at terminal 1 and terminal 4 of that coupler as $$\frac{100}{2\sqrt{2}} \angle 0° + \phi \text{ and } \frac{100}{2\sqrt{2}} \angle -90° + \phi ,$$

and respectively. At the same time, if B phase shifter 17 is under the control of a binary one command signal (B') through lead 22, the signal at terminal 3 of coupler 14, designated as $$\frac{100}{2} \angle -90° .$$

will appear at terminals 1 and 4 of that coupler as $$\frac{100}{2\sqrt{2}} \angle -180° + \phi \text{ and } \frac{100}{2\sqrt{2}} \angle -90° + \phi ,$$

respectively. Then the two signals at terminal 1 of coupler 14 will cancel out each other, because they are out of phase, and the two signals at terminal 4 of the coupler will combine, because they are in phase. The combined signal at terminal 4 of coupler 14, now at $$\frac{100}{\sqrt{2}} \angle -90° + \phi ,$$

enters terminal 2 of coupler 13 and appears at terminal 1 and 4 of the coupler as $$\frac{100}{2} \angle -90° + \phi \text{ and } \frac{100}{2} \angle -180° + \phi ,$$

respectively.

Similarly, if both C and D phase shifters 18 and 19 are under the control of binary one command signals at C' and D' through leads 23 and 24, respectively, the signal $$\frac{100}{\sqrt{2}} \angle -90° .$$

at terminal 3 of coupler 12 enters terminal 1 of coupler 15 and emerges from terminal 4 of the coupler as $$\frac{100}{\sqrt{2}} \angle -180° + \phi$$

and none of this signal is returned back to coupler 12. The signal at terminal 4 of coupler 15 enters terminal 3 of coupler 13 and appears at terminals 1 and 4 of the coupler as $$\frac{100}{2}\angle -270^\circ + \phi \text{ and } \frac{100}{2}\angle -180^\circ + \phi$$

respectively. As a result, two signals at terminal 1 of coupler 13, designated as $$\frac{100}{2}\angle -90^\circ + \phi \text{ and } \frac{100}{2}\angle -270^\circ + \phi ,$$

cancel out each other, because they are equal in amplitude, but out of phase; and the two signals at terminal 4 of coupler 13, both designated as $$\frac{100}{2}\angle -180^\circ + \phi ,$$

combine to $\angle 100 \quad -180^\circ + \phi$, because they are in phase. This combined signal will emerge from switch terminal IV through transformer 28. Hence, the signal fed to switch terminal I will appear wholly at switch terminal IV and no signal appears at switch terminals II and III.

At the same time, the signal fed to switch terminal II will undergo a similar phase shifting process and appear wholly at switch terminal III, and none of that signal will appear at switch terminals I and IV. Therefore, the command word 1 1 1 1 produces the switching state designated I–IV and II–III, as shown in Table I. The same analysis applies for the case of command word 0 0 0 0, and the switching state is again I–IV and II–III. The only difference between the two cases is that the phases of transmitted signals differ by 180°. As a matter of fact, the complement of a command word produces the same switching state as the command word, but the outputs are shifted 180° in phase.

Similar analysis reveals that other command words listed in Table I produce the switching state also listed. It should be noted that a command word or the complement of the word will produce the same state of the switch, but with 180° phase difference. It should also be noted that the four different switching states, including the state where all terminals are isolated from each other, can be produced by four command words in which any one of the command signals A′, B′, C′ or D′ is invarient, if the 180° phase shift by complementary word is not required. Clearly, the invarient command signal can be eliminated and the associated phase shifter circuit fixed to either state of the phase shifter depending upon what series of command words are elected for use. For example, if the command words 1 1 1 1, 0 0 1 1, 1 0 0 1 and 0 1 0 1 are used, then command signal D′ can be eliminated and phase shifter circuit D can be invarient.

The hybrid couplers in the basic switch shown in FIG. 1 can be 3db 180° couplers or Magic Ts or circuits which perform as classical Magic-T devices. A 3db 180° coupler or Magic-T is a four-port device, in which two ports are designated as the sum port and the difference port. In preferred embodiments of the present invention, in reference to FIG. 1, terminal 1 of each of the four couplers is the sum port, and terminal 4 of the same coupler is the difference port. These two terminals 1 and 4 are isolated from each other and so are terminals 2 and 3. When signals are applied to each of terminals 2 and 3, the sum of these two signals appears at terminal 1, and the difference appears at terminal 4. Furthermore, when a signal is fed to terminal 1, the signal is divided equally and in phase between terminals 2 and 3; but, when a signal is fed to terminal 4, the signal is divided equally in amplitude, but in opposite phase between terminals 2 and 3. If the four hybrid couplers 12, 13, 14 and 15 in the basic circuit are all 3db 180° couplers or Magic-T circuits, then the switching states of the basic circuit produced by the command words are as shown in Table II below.

TABLE 2

ALL HYBRID COUPLERS ARE 3DB 180°-COUPLERS OR MAGIC-Ts

| Command Signals A′ | B′ | C′ | D′ | | Terminals Electrically Isolated (minimum insertion loss) | | | |
|---|---|---|---|---|---|---|---|---|
| 1 | 1 | 1 | 1 | or | All terminals isolated; | at | 0° | or |
| 0 | 0 | 0 | 0 | | I-I, II-II, III-III and IV-IV | | 180° | |
| 0 | 0 | 1 | 1 | or | I-II and III-IV | at | 0° | or |
| 1 | 1 | 0 | 0 | | | | 180° | |
| 1 | 0 | 0 | 1 | or | I-IV and II-III | at | 0° | or |
| 0 | 1 | 1 | 0 | | | | 180° | |
| 0 | 1 | 0 | 1 | or | I-III and II-IV | at | 0° | or |
| 1 | 0 | 1 | 0 | | | | 180° | |

For example, when a signal is applied to terminal 1 of coupler 12, the signal will divide equally in amplitude and in phase between terminals 2 and 3 of the coupler. If the command word is 1 1 1 1 or 0 0 0 0, the reflected signals at terminals 2 and 3 of each coupler 14 and 15 are equal in amplitude and in phase; hence, they combine at their respective sum port which is terminal 1 of each coupler 14 and 15. Therefore, the divided two signals are returned to same terminals 2 and 3 of coupler 12, equal in amplitude and in phase so that they combine wholly at terminal 1 of the said coupler.

Similarly, when a signal is applied to terminal 4 of coupler 12, the signal will divide equally in amplitude, but in opposite phase between terminals 2 and 3. The command word 1 1 1 1 or 0 0 0 0 merely reflects back the signal entering terminal 1 of each coupler 14 and 15 to the same terminal. Thus, the two reflected signals at terminals 2 and 3 of coupler 12 are equal in amplitude, but opposite in phase and so they appear wholly at the difference port which is terminal 4 of the coupler. The same applies when signals are applied at terminals 1 and 4 of coupler 13; that is, the command word 1 1 1 1 or 0 0 0 0 will produce the switching state wherein all terminals are isolated from each other. For other command words a similar analysis will result in the switch states listed in Table 2. The analysis also shows that the two command words, which are complementary to each other, will result in the same switching pattern, but opposite phases at the switch output terminals.

As can be seen by Table 2, the same command words are used and the same switching states of the basic circuit are produced as in Table 1, however, the command words and switching states correspond differently. For example, when all the hybrid couplers are 3db 180°-couplers, a command word of 1 1 1 1 or 0 0 0 0 causes all terminals of the switch to be isolated from each other.

The basic switch in FIG. 1 can also be made up of a combination of different types of hybrid couplers. For example, the two terminal hybrid couplers 12 and 13 may be 3db 180°-couplers and the two internal couplers 14 and 15 may be 3db 90°-couplers. In that case, operation of the basic circuit is as set forth in Table 3 below.

TABLE 3

TERMINAL COUPLERS ARE 3DB 180°-COUPLERS
INTERNAL COUPLERS ARE 3DB 90°-COUPLERS

| Command Signals A' | B' | C' | D' | | Terminals Electrically Coupled (minimum insertion loss) | | | |
|---|---|---|---|---|---|---|---|---|
| 1 | 1 | 1 | 1 | or | I-III and II-IV | at | 0° | or |
| 0 | 0 | 0 | 0 | | | | 180° | |
| 0 | 0 | 1 | 1 | or | I-IV and II-III | at | 0° | or |
| 1 | 1 | 0 | 0 | | | | 180° | |
| 1 | 0 | 0 | 1 | or | I-II and III-IV | at | 0° | or |
| 0 | 1 | 1 | 0 | | | | 180° | |
| 0 | 1 | 0 | 1 | or | All terminals isolated; | at | 0° | or |
| 1 | 0 | 1 | 0 | | I-I, II-II, III-III and IV-IV | | 180° | |

On the other hand, the terminal couplers 12 and 13 may be 3db 90°-couplers and the internal couplers 14 and 15 may be 3db 180°-couplers. In that case, operation is as shown in Table 4 below.

TABLE 4

TERMINAL COUPLERS ARE 3DB 90°-COUPLERS
INTERNAL COUPLERS ARE 3DB 180°-COUPLERS

| Command Signals A' | B' | C' | D' | | Terminals Electrically Coupled (minimum insertion loss) | | | |
|---|---|---|---|---|---|---|---|---|
| 1 | 1 | 1 | 1 | or | I-II and III-IV | at | 0° | or |
| 0 | 0 | 0 | 0 | | | | 180° | |
| 0 | 0 | 1 | 1 | or | All terminals isolated; | at | 0° | or |
| 1 | 1 | 0 | 0 | | I-I, II-II, III-III and IV-IV | | 180° | |
| 1 | 0 | 0 | 1 | or | I-III and II-IV | at | 0° | or |
| 0 | 1 | 1 | 0 | | | | 180° | |
| 0 | 1 | 0 | 1 | or | I-IV and II-III | at | 0° | or |
| 1 | 0 | 1 | 0 | | | | 180° | |

Other combinations of different kinds of hybrid couplers could also be used in the basic switch shown in FIG. 1 and with each different combination, the command words that bring about different switching states would be the same, however, the correlation between the words and the states would be unique to the particular combination. Clearly, many different combinations of quadrature, opposite and equal phase four port hybrid couplers may be used in the basic switch shown in FIG. 1, and the switch will be capable of the four switching states or eight switching states, including two phases in each state, listed in Tables 1 to 4. For each combination, however, the command word that produces any given switching state may be different just as they are in the four examples given above. Also, in the four examples described and in many other combinations which are two numerous to describe herein, one of the phase shifter circuits A, B, C or D may be invarient and so, only three command signals are needed, if the controllable biphase states are not required.

Since the basic switching circuit produces four different switching states, (disregarding the biphase states), represented by four different binary command words, it is quite possible to encode the command words in a logic circuit that responds to two bit binary code words. For example, where all the hybrid couplers are 3db 90°-couplers, and so operation is as shown in Table 1 above, the command words produced by two bit binary code words could be as listed below.

| Two Bit Code Word | Command Words |
|---|---|
| 00 | 1001 |
| 10 | 0101 |
| 01 | 0011 |
| 11 | 1111 |

By this arrangement, a binary code word 00 causes all terminals of the switch to be isolated from each other.

A binary code word 10 couples I to II and III to IV. The code word 01 couples I to III and II to IV and code word 11 couples I to IV and II to III. The logic circuit for converting code words to command words could be located within the encapsulated package 11 of the basic switch and so, only two control lines would be required to the encapsulated switch in order to accomplish all of the four switching states.

In case of the 180° phase shift introduced for each switching state by complementary command word, resulting in a total of eight states or four biphase states, the code words can each be a three bit binary number fed to suitable logic circuits which produce the four bit command words. These three bit binary code words can take many forms. For the case where all couplers are 3db 90°-couplers, one set of such three bit binary code words is listed below.

| ALL HYBRID COUPLERS ARE 3DB 90°-COUPLERS | | | | | | | | |
|---|---|---|---|---|---|---|---|---|
| Code Words | | | Command Words | | | | Switching States | Phase |
| 0 | 0 | 0 | 1 | 0 | 0 | 1 | I-I, II-II, III-III and IV-IV | 0° |
| 0 | 0 | 1 | 0 | 1 | 1 | 0 | | 180° |
| 1 | 0 | 0 | 0 | 1 | 0 | 1 | I-II and III-IV | 0° |
| 1 | 0 | 1 | 1 | 0 | 1 | 0 | | 180° |
| 0 | 1 | 0 | 0 | 0 | 1 | 1 | I-III and II-IV | 0° |
| 0 | 1 | 1 | 1 | 1 | 0 | 0 | | 180° |
| 1 | 1 | 0 | 1 | 1 | 1 | 1 | I-IV and II-III | 0° |
| 1 | 1 | 1 | 0 | 0 | 0 | 0 | | 180° |

The phase shifter circuits A, B, C and D are preferably identical in the basic switch, except that one may be invarient for the reasons already described, and so that one may be constructed differently from the other. FIG. 2 shows simple constructions of a phase shifter circuit which can be controlled by a binary command signal to return an incident signal either in one reference phase or at 180° from the reference phase.

In FIG. 2, the phase shifter circuit consists of a PIN diode, which is controlled to be either in a high impedance state in reverse biased condition or in a low impedance state in forward biased condition; $L_1$, the equivalent series inductance; $C_1$, the external equivalent shunt capacitance; $L_2$, the RF choke, which will pass only the command signal, (but, block off the RF signal); and $C_2$, the blocking capacitor which will pass only the RF signal, (but, block off the command signal). The physical locations of $L_2$ and $C_2$ are not necessarily at the input of the phase shifter, but can be at any convenient place. The equivalent circuits of the phase shifter under two different bias conditions of the PIN diode are shown in FIG. 3(*a*) and FIG. 3(*b*).

In the forward biased condition, the outgoing reflected signal, ideally without any loss, will undergo a certain amount of phase shift, which is arbitrarily taken as the reference phase. At the reverse biased condition, the $C_d$, which represents the diode junction capacitor, the $L_1$ and the $C_1$ form a type of low pass filter in which the reflected signal, (again, ideally without any attenation), will introduce a phase shift of 180° from the reference phase. Therefore, the phase shifter introduces a 180° phase shift from a forward biased condition to a reverse biased condition of the PIN diode and the two biased conditions of the diode are controlled by a binary control (command) signal. The bandwidth of the phase shifter shown in FIG. 2 can be extremely wide and depends mostly upon the value of the diode junction capacitor. This type of circuit is usually used from the HF band to the higher end of the microwave region.

Figure 4:
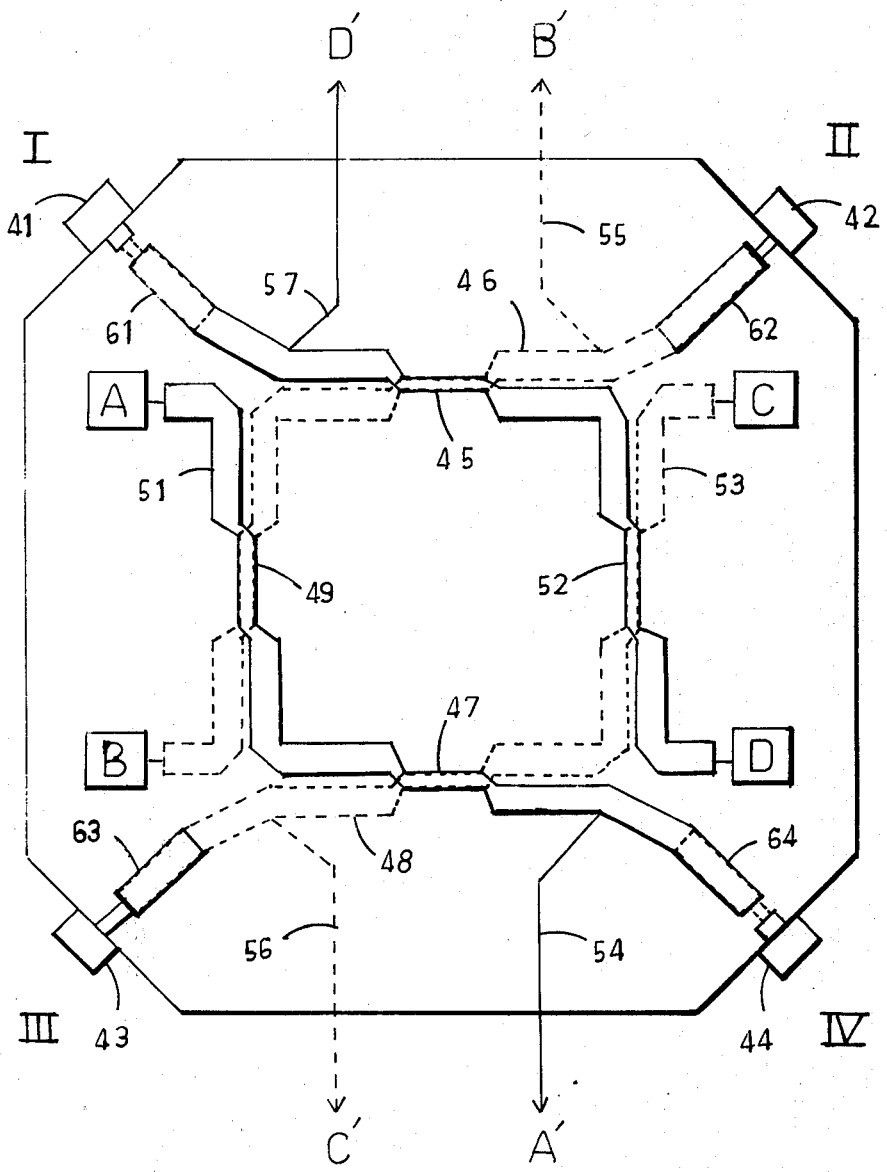
FIG. 4 is a plane view of a circuit board showing construction of a switch incorporating all the features of the switch shown in FIG. 1 using 3db 90° couplers for switching high frequency signals.

A typical construction and packaging of the basic circuit incorporating four 3db 90°-couplers and operated as described in Table 1, is illustrated in FIG. 4. The circuit is well suited for wide band width operation in the microwave frequency range. The circuit is in a stripline structure, wherein three dielectric boards are used as bottom half board, top half board and center board. The figure shows the circuit pattern on both sides of the center board, wherein the pattern of solid lines is on one side and the pattern of dotted lines is on the other side. Each coupler is formed by two three-quarter-wavelength conductors, one on each side of the center board, where the middle section of the quarter-wavelength is broad side-coupled and both end sections of the quarter-wavelength are side-coupled. Thus, striplines 45 and 46 form a 3db 90°-coupler which is equivalent to the hybrid coupler 12 in FIG. 1. Similarly, lines 47 and 48, lines 49 and 51, and lines 52 and 53 form couplers equivalent to the hybrid couplers of 13, 14 and 15, respectively, in FIG. 1. The phase shifter circuits A, B, C and D are connected as shown to the terminals of the associated couplers. The fine lines 54, 55, 56 and 57 are lines for command signals at A′, B′, C′ and D′, respectively, and correspond to lines 21, 22, 23 and 24 in FIG. 1. The coupled lines 61, 62, 63 and 64 are transformers at the associated switching terminals, which correspond to 25, 26, 27 and 28 in FIG. 1. The terminals from 41 to 44 correspond to the switching terminals from I to IV.

The numerous embodiments of the present invention described herein all include a plurality of hybrid couplers and an equal number of phase control circuits in a symmetrical electrical arrangement to provide a switch capable of a plurality of electrical states depending upon command or control signals applied to the phase shifter circuits. These embodiments are described by way of examples of uses of the invention and it will be apparent to those skilled in the art that other kinds and combinations of hybrid couplers and other kinds of phase shifter circuits could be substituted for those described herein without departing from the spirit and scope of the invention as set forth in the appended claims.

What is claimed is:

1. An electrical switch having a plurality of switch terminals for switching frequency electrical signals fed to the switch terminals between the switch terminals depending upon the electrical state of the switch comprising, four switch terminals I, II, III and IV, four hybrid couplers of which two are switch terminal couplers and two are switch internal couplers, each hybrid coupler having four terminals and each dividing power of a signal fed to any terminal thereof equally between two other terminals thereof, switch terminals I and II being different terminals of one of said switch terminal couplers, switch terminals III and IV being different terminals of the other of said switch terminal couplers, the other terminals of said two switch terminal couplers being connected to terminals of said internal couplers, at least one controlled phase shifter circuit connected to at least one other internal coupler terminal for intercepting signals issuing therefrom and returning the intercepted signal to the same said internal coupler terminal and means for controlling said controlled phase shifter circuit to cause a change in the returned, intercepted signal, whereby said change causes a change in the electrical state of the switch.

2. An electrical switch as in claim 1, including, means for providing two phase states for each switching state.

3. An electrical switch as in claim 1 wherein, the change in the returned intercepted signal caused by the controlled phase shifter means is a change in signal phase.

4. An electrical switch as in claim 1 wherein, there are at least three of said controlled phase shifter circuits, each intercepting signals issuing from a different one of said other internal coupler terminals.

5. An electrical switch as in claim 1 wherein, said means for controlling produces a different control signal for each of said controlled phase shifter means, said control signals are produced simultaneously, the simultaneous control signals define a control word, several different control words are produced and each control word results in a different switching state of the switch.

6. An electrical switch as in claim 5 wherein, the change in the returned intercepted signal by each control phase shifter is a change in signal phase by an odd multiple of 180°.

7. An electrical switch as in claim 5 wherein, the intercepted returned signals by each control means is one of two relative phases which differ by an odd multiple of 180°, the control signals are each binary, the control words are each binary, and there are at least two binary words.

8. An electrical switch as in claim 7 wherein, there are at least three different binary words, the first, second and third words, whih cause first, second and third electrical states of the switch, respectively, and in which states insertion loss between switch terminals is a minimum as follows:

1st state: I to III and II to IV

2nd state: I to II and III to IV

3rd state: I to IV and II to III.

9. An electrical switch as in claim 8 wherein, the compliments of said binary words produce the same switching states, but in opposite phase.

10. An electrical switch as in claim 8 wherein, another binary control word causes all the switch terminals to be substantially isolated from each other and a signal launched at any terminal is reflected therefrom at given phase.

11. An electrical switch as in claim 9 wherein, the compliment of said other binary control word produces said isolation and said reflection is in opposite phase to said given phase.

* * * * *